United States Patent [19]

Clark

[11] Patent Number: 4,497,758

[45] Date of Patent: Feb. 5, 1985

[54] METHOD OF FORMING BOTTLE NECK FINISH FOR ACCEPTING A SNAP-IN CLOSURE

[75] Inventor: Richard E. Clark, Merrimack, N.H.

[73] Assignee: The Continental Group, Inc., Stamford, Conn.

[21] Appl. No.: 505,037

[22] Filed: Jun. 16, 1983

Related U.S. Application Data

[62] Division of Ser. No. 259,205, Apr. 30, 1981.

[51] Int. Cl.[3] ..... B06B 3/00

[52] U.S. Cl. ..... 264/23; 264/320; 264/322

[58] Field of Search ..... 264/23, 320, 322; 425/174.2, 392

[56] References Cited

U.S. PATENT DOCUMENTS

| | | | |
|---|---|---|---|
| 3,171,458 | 3/1965 | Strong | 150/0.5 |
| 3,773,205 | 11/1973 | Keeler et al. | 264/23 |
| 4,356,926 | 11/1982 | Priestly et al. | 264/23 |

FOREIGN PATENT DOCUMENTS 554079 1/1957 Italy .

*Primary Examiner*—Theodore Morris
*Assistant Examiner*—W. Thompson
*Attorney, Agent, or Firm*—Charles E. Brown

[57] ABSTRACT

This relates to the provision of a snap-in closure for plastic beverage bottles. The neck of a conventional bottle is foreshortened through the elimination of the customary closure threads and the extreme end of the neck is reformed by way of an ultrasonic tool to define a radially inwardly turned sealing flange having a pour opening of a preselected controlled diameter therethrough. A snap-in closure is provided with the closure including a plug with a radially outwardly directed flange, the plug and flange being snapable through the pour opening in the sealing flange and the closure flange and thereafter engaging the sealing flange to seal the bottle. This abstract forms no part of the specification of this application and is not to be construed as limiting the claims of the application.

2 Claims, 5 Drawing Figures

METHOD OF FORMING BOTTLE NECK FINISH FOR ACCEPTING A SNAP-IN CLOSURE

This is a division of Ser. No. 259,205, filed Apr. 30, 1981.

This invention relates in general to new and useful improvements in container construction, and primarily to improvements in bottles for carbonated beverages.

At the present time, the customary bottle for carbonated beverages is provided with a screw threaded closure which requires threads of an axial extent on the neck finish of the bottle. As a result, the neck portion of a beverage bottle is unduly elongated for no useful purpose other than to receive the screw threaded closure.

It has been found that if a different type of closure is utilized, the end portion of the bottle neck normally provided with the threads may be removed, thus effecting a savings on the order of 2 to 3 grams of the resin from which the bottle is formed.

The difficulty in providing a bottle neck finish with a closure other than a snap-in or threaded closure is that the neck finish is normally injection molded during the molding of the preform from which the bottle is formed, and, since the preform must have an internal core, the interior of the neck finish must be smooth and free of either projections or undercuts. Otherwise, the core can not be stripped relative to the preform.

In accordance with this invention, it is proposed to reform the bottle neck finish so that the extreme free end of the initially formed bottle neck is reformed and folded radially inwardly to define a radially inwardly directed flange. A bottle neck finish with such a flange may then receive a snap-in closure with the bottle neck flange cooperating with a flange on the closure to form a seal.

It has been found in accordance with this invention that the reforming of the end of the bottle neck may be expeditiously and advantageously effected utilizing an ultrasonic tool. The tool is constructed so as to telescope over the neck finish with the free end of the neck finish abutting an end wall of the tool so that when the tool is actuated and telescoping of the tool and neck finish continues, the end portion of the neck will be deformed radially inwardly to form a radially inwardly directed flange. Advantageously, the tool will also include a centerpost against which the flange being formed will abut so as to mold in the flange a pour opening of a preselected positive diameter. This, together with a controlled stopping of the telescoping of the tool and the neck, will result in automatic formation of a terminal flange on the neck of the desired dimensions.

With the above and other objects in view that will hereinafter appear, the nature of the invention will be more clearly understood by reference to the follance with this invention and provided with a closure.

Figure 1:
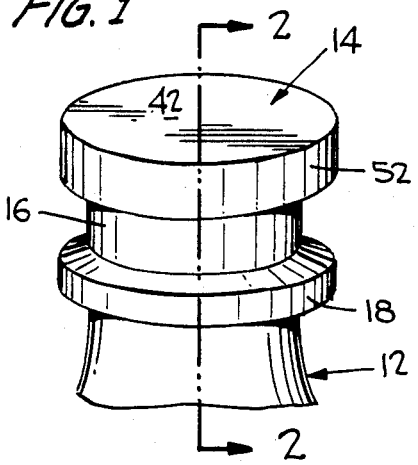

Referring now to the drawings in detail, it will be seen that there is illustrated in FIG. 1 a conventional container in the form of a bottle 10 having a neck finish 12. The neck finish 12 carries a closure generally identified by the numeral 14. The neck finish 12 is especially formed in accordance with this invention to receive the closure 14.

Figure 2:
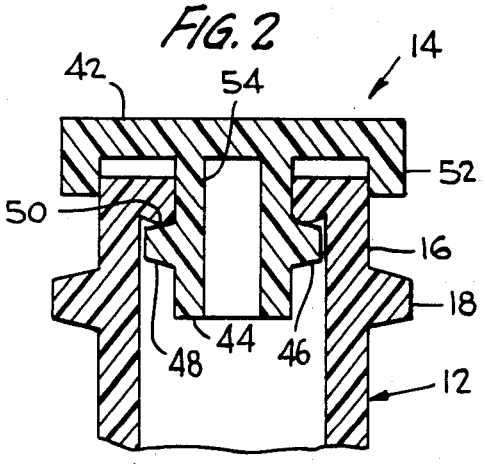
FIG. 2 is a vertical sectional view taken generally along the line 2—2 of FIG. 1, and shows the cross-sectional details of both the bottle neck finish and the closure.

Referring now to FIG. 2, it will be seen that the neck finish 12 initially is in the form of a cylindrical neck portion 16 which is provided with a radially outwardly directed annular supporting flange 18 by which the bottle 10 may be supported during a filling operation, etc. Actually, the flange 18 is formed as part of the original neck finish 12 in the preform stage and is used to support the preform during certain stages of the blow molding operation.

It is to be noted that the cylindrical neck 16 is initially free of either internal or external projections, particularly external projections such as external screw threads by means of which a closure is normally applied to the bottle. It is further to be understood that the portion of the neck 16 above the flange 18 has been materially foreshortened and that on a conventional size bottle neck there may be a lessening of the neck material on the order of 2 to 3 grams.

Figure 4:
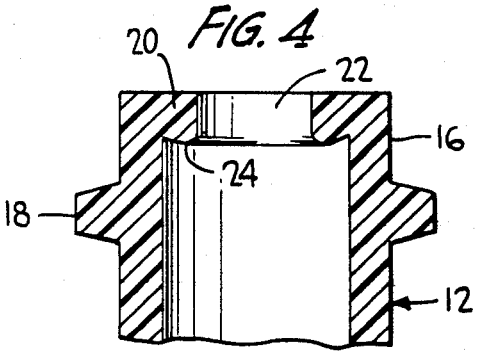
FIG. 4 is a fragmentary vertical sectional view similar to FIG. 3, and shows the extreme end of the neck finish reformed to define a sealing flange.

The neck finish 12, as formed, is not capable of having associated with it a closure for the bottle 10. Accordingly, in accordance with this invention, the extreme upper part of the neck 16 is worked upon to define an inwardly directed radial flange 20, as is best shown in FIG. 4. The flange 20 has a pour opening 22 therethrough of a preselected controlled diameter. The flange 20 is in the form of a sealing flange and has on the underside thereof a sealing surface 24.

Figure 5:
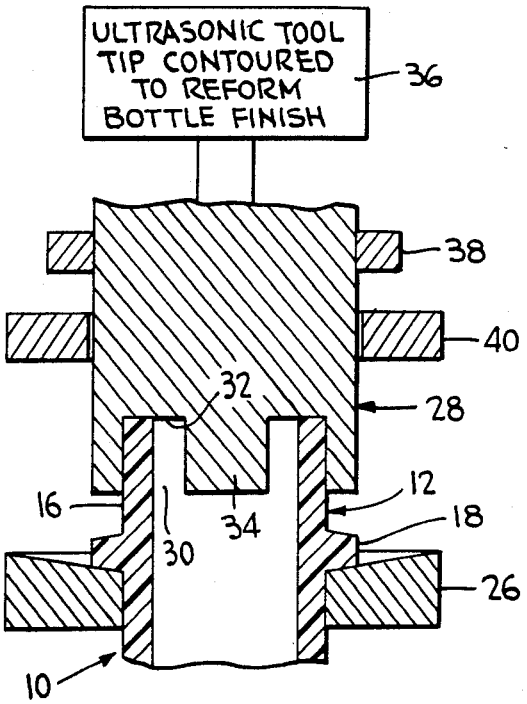
FIG. 5 is a fragmentary vertical sectional view through the lower part of the tool, with the tool in position for initiating reforming of the extreme end of the bottle neck.

Reference is now made to FIG. 5, wherein there is schematically illustrated the manner in which the flange 20 is formed. It will be seen that the neck finish is supported on a suitable fixed support 26 by way of the flange 18. With the neck finish so supported, it is associated with a reforming tool generally identified by the numeral 28. The tool 28 is provided with an end bore 30 which terminates in an axially inner end wall 32. A centerpost 34 extends from the end wall 32 in concentric relation to the bore 30. The centerpost 34 is of a diameter in accordance with the preselected diameter of the pour opening 22.

It is to be understood that the end bore 30 is of a diameter to have received therein the free upper portion of the neck 16 with the neck 16 engaging the end wall 32. The tool 28 is an ultrasonic tool, and for descriptive purposes only, the illustrated tool 28 is schematically shown as being coupled to an ultrasonic vibrator 36.

With the ultrasonic vibrator 36 acting to vibrate the tool 28, the neck 16 and the tool 28 are further telescoped with the end portion of the neck 16 flowing radially across the end wall 36 until it strikes the centerpost 34. The telescoping together of the tool 28 and the neck 16 is controlled so as to control the axial thickness of the flange 20. It is to be understood that to this end there will be provided automatic stop means as part of the tool 28 to limit the telescoping of the neck 16 with the tool. However, for illustrative purposes only, the tool 28 is shown as having a stop flange 38 which is engageable with a preset stop ring 40.

Figure 3:
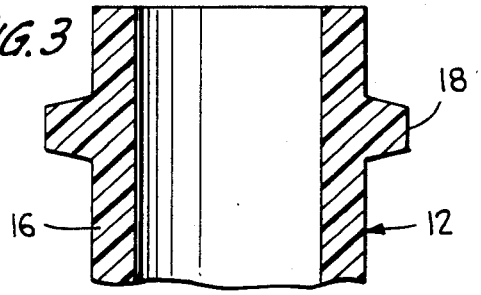
FIG. 3 is a fragmentary vertical sectional view through the neck finish of the bottle as originally formed.

At this time, while the forming of the flange 20 has been specifically described as occurring with respect to the container or bottle 10, it is to be understood that since the neck finish, as illustrated in FIG. 3, does exist in the preform stage, it is feasible to effect the forming of the flange 20 in the preform stage although normally this would not be preferred in that curing the blow molding of a preform to a bottle configuration it is necessary that the neck finish 12 receive a suitable blow fitting as well as at least a centering rod and the diameter of the pour opening 22 may be restricted. This is particularly true with smaller diameter neck finishes.

Referring now to FIG. 2, it will be seen that the closure 14 includes an end wall 42 having projecting downwardly therefrom a hollow plug 44. The plug 44 carries a radially outwardly directed flange 46 which has a tapered undersurface 48 and a tapered upper surface 50.

The end wall 42 is also provided with a depending annular flange or skirt 52. The skirt 52 is of a diameter to be snugly telescoped over the upper end of the neck 16 for the purpose of excluding foreign matter. It does not, however, form a gas-tight seal with the neck 16.

It is to be understood that the diameter of the flange 46 with respect to the poubottle 10. The flange 20 will deflect radially outwardly and downwardly while the flange 46 will deflect radially inwardly and upwardly.

It is to be understood that when the closure 14 is initially applied to the neck finish 12, the end wall 42 will seat on the upper surface of the flange 20. It is further to be understood that an initial seal will be formed between the upper portion 54 of the plug 44 and that portion of the flange 20 which defines the pour opening 22. Thus, gaseous pressure within the bottle 10 will serve to force the plug 44 axially upwardly to bring the surface 50 of the flange 46 into sealing engagement with the sealing surface 24 of the flange 20. Further, gaseous pressure within the hollow plug 44 will result in the plug being radially outwardly expanded so as to form a tight secondary seal between the upper plug portion 54 and the flange 20.

It thus will be seen from FIG. 2 that the end wall 42 will be spaced above the flange 20 a distance equal to that required to permit the flange 46 to pass through the pour opening 22. In a like manner, the depending flange or skirt 52 must be of sufficient axial extent so as to be telescoped over the neck 16 when the closure 14 is in its uppermost operative position.

Although only a preferred embodiment of the invention has been specifically illustrated and described herein, it is to be understood that minor variations may be made in the neck finish, the closure, and the manner of and means for reforming the neck to form the sealing flange on the neck finish without departing from the spirit and scope of the invention as defined by the appended claims.

I claim:

1. A method of adapting a tubular neck portion of a plastic container for the reception of a closure, said method comprising the step of supporting the container, providing a tool having an end bore of a size to receive in telescoped relation a free end of a container neck portion and a central sizing plug in said end bore, telescoping the tool and the container neck portion with an extreme end of the container neck portion engaging an end wall of the end bore, and continuing the telescoping of the tool and the container neck portion with the free end of the container neck portion being gradually radially inwardly deformed to form a radially inwardly directed flange and the flange is shaped about the centerpost.

2. The method of claim 1 wherein said tool is subjected to ultrasonic vibrations.

* * * * *